US012404067B2

(12) United States Patent
Hammersten

(10) Patent No.: US 12,404,067 B2
(45) Date of Patent: Sep. 2, 2025

(54) EXPANDABLE BOTTLE

(71) Applicant: Noah Hammersten, Studio City, CA (US)

(72) Inventor: Noah Hammersten, Studio City, CA (US)

( * ) Notice: Subject to any disclaimer, the term of this patent is extended or adjusted under 35 U.S.C. 154(b) by 10 days.

(21) Appl. No.: 18/316,478

(22) Filed: May 12, 2023

(65) Prior Publication Data

US 2023/0365287 A1 Nov. 16, 2023

Related U.S. Application Data

(60) Provisional application No. 63/341,349, filed on May 12, 2022.

(51) Int. Cl.

| | |
|---|---|
| ***B65D 1/02*** | (2006.01) |
| ***B65D 21/02*** | (2006.01) |
| ***B65D 41/04*** | (2006.01) |
| ***B65D 43/16*** | (2006.01) |

(52) U.S. Cl.

CPC ..... *B65D 1/0292* (2013.01); *B65D 1/0246* (2013.01); *B65D 1/0276* (2013.01); *B65D 21/0213* (2013.01); *B65D 41/04* (2013.01); *B65D 43/169* (2013.01); *B65D 2543/00092* (2013.01)

(58) Field of Classification Search

CPC ..... B65D 21/0234; B65D 21/0233; B65D 21/086; B65D 1/0292; B65D 1/0207; B65D 1/0246; B65D 2543/00092; B65D 2543/00972; B65D 2501/0018; Y10S 215/90; Y10S 220/907; A45F 2003/205; A45F 3/20; B29C 49/4283

USPC ..... 215/382, 10, 900; 220/666, 8

See application file for complete search history.

(56) References Cited

U.S. PATENT DOCUMENTS

| | | | | |
|---|---|---|---|---|
| 2,886,084 | A * | 5/1959 | Davison | B65D 21/086 220/666 |
| 5,209,372 | A * | 5/1993 | Norwood | B65D 1/0292 220/666 |
| 5,348,173 | A | 9/1994 | Norwood | |
| 5,584,413 | A * | 12/1996 | Jung | B65D 1/0292 220/666 |
| 2017/0320611 | A1 | 11/2017 | Shen | |
| 2018/0155209 | A1 | 6/2018 | Cohen | |

FOREIGN PATENT DOCUMENTS

| | | |
|---|---|---|
| FR | 2765556 | 1/1999 |
| JP | 2015127248 | 7/2015 |
| WO | 9415846 | 7/1994 |
| WO | 2015076362 | 5/2015 |

OTHER PUBLICATIONS

International Search Report dated Nov. 2, 2023.
Written Opinion of the International Searching Authority dated Nov. 2, 2023.

* cited by examiner

*Primary Examiner* — King M Chu
(74) *Attorney, Agent, or Firm* — Dergosits & Noah LLP; Igor Shoiket

(57) ABSTRACT

Collapsible bottles and methods of use are disclosed in which the bottle is fabricated, collapsed at a body section including circular or spiral folds, provided with a condensed or concentrated substance, and sealed. Subsequently, the bottle may be unsealed, expanded, provided with a liquid, sealed, and mixed to bring the substance to a desired concentration or consistency.

19 Claims, 14 Drawing Sheets

EXPANDABLE BOTTLE

CROSS-REFERENCE TO RELATED CASES

This application claims priority to U.S. Provisional Patent Application No. 63/341,349, entitled "Expandable Bottle," filed on May 12, 2022, which is hereby incorporated by reference.

BACKGROUND

Typical bottled products include a volume of a liquid, e.g., water. This liquid is often relatively heavy. In addition, the volume adds a spatial requirement to shipping, storage, and display considerations.

Thus, a bottle is needed that provides for reduced weight and space considerations.

BRIEF DESCRIPTION OF THE DRAWINGS

The embodiments are illustrated by way of example and not limitation in the accompanying drawings, in which like references indicate similar elements, and in which.

DETAILED DESCRIPTION

Figure 1C:
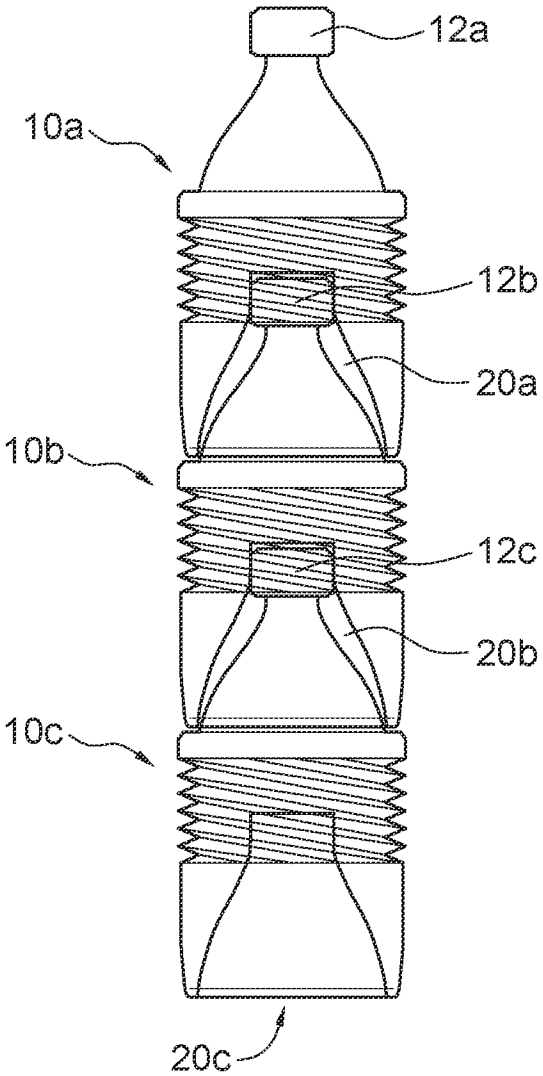
FIG. 1C is a side view illustrating the embodiment of FIG. 1 stacked.

Embodiments described within disclose a vehicle for the sale of single-serving dehydrated foodstuffs in an expandable bottle. The foodstuff may include, e.g., baby formula, protein powder, powdered meal replacement, or the like. Embodiments may also be vehicles for containing condensed or dehydrated materials for later dilution or rehydration, including both foodstuffs and non-foodstuffs.

In a use case, an embodiment is distributed or sold with the material added and the bottle collapsed. In such an embodiment, a consumer may purchase the bottle individually or in bulk. When the ready to consume the product, the consumer opens the bottle, expands it, fills it with water or other liquid, and mixes the material and the liquid.

The expandability allows for the convenience of a liquid bottled product with the shelf-space, weight, and cost savings more similar to a dry product bought in a tub or bag.

Embodiments may also be stackable.

In an embodiment, the walls of the bottle may be bi-stable so the bottle remains in either of a fully collapsed or a fully extended position. For example, regarding the shape of the folds, in an embodiment, like a measuring tape which will happily coil, or when straightened remain rigid, the body of the bottle will remain in a collapsed or extended position, with force required to transition between. In a position mid-way between collapsed and extended, the outer edge of each fold will be stretched, or otherwise deformed, slightly, creating an over-center condition. In other words, when transitioning from collapsed to extended, as the neck is moved away from the bottom, for each fold, an outer apex of a fold follows an arc. Initially, the apex is relatively closer to a center axis of the bottle and, as the bottle is expanded, the apex arcs up and away from the center axis. At a mid-way point in the expansion, the arc of the apex is furthest from the bottle center axis. With further expansion, the apex travels further along the arc, becoming closer to the center axis along the way. In an embodiment, when expanding, for the apex of each fold (both circular and spiral) to arc away from the center axis requires a slight stretch of the bottle material. Similarly, compression requires a stretch of the bottle material for the apex to make the return arc. Thus, without effort being exerted to expand or compress the bottle and stretch the material in the process, the material will not, on its own or by the force of gravity, make the transition to the other state. Thus, the need to stretch the material to change states results in the bottle being bi-stable.

In an embodiment with a spiral fold, when expanding or compressing the bottle, the top section of the bottle twists relative to the bottom section. When the spiral is oriented with the spiral in a left-hand orientation (as shown in FIG. 5B), the top section rotates counter clockwise (viewed from above) when expanding to feel like the opening of a normal threaded cap.

In an embodiment, the walls of the bottle may be expandable, but after being expanded, are not readily collapsible. In an embodiment, the body of the bottle may be configured to assume the extended position by default, with force required to compress the folds of the body, much that that required to compress a spring. The bottle may then be held in the collapsed position by vacuum when sealed. When the seal is breached, the folds would spring open and the bottle would return to the extended position.

In an embodiment, the wall of the body of the bottle, which contains the folds that provide for the expansion, For example, may have a thickness that is uniform at all locations of the fold, e.g., a spiral or pleat.

In an embodiment, a mesh or filter may be included in a bottle cap. In an embodiment, an arm may be attached to the cap to be inserted into the bottle and used in mixing the ingredients within the bottle.

In an embodiment, because the bottle is holding dry goods instead of water, the material from which the bottle is constructed is less robust than if the bottle were to be sold with the volume of liquid that will eventually be added to the dry goods. For example, less robust bottles may be more biodegradable and constructed of, e.g., bio-plastics (PHA), corn or mycelium plastic alternatives, etc.

Generally, embodiments are directed to collapsible bottles that may be or are provided with a dry food sealed within, and that may be expanded to allow the dry food within to be rehydrated or otherwise diluted. In addition, embodiments are directed to collapsible bottles that may be or are provided with a concentrated substance sealed within, and that may be expanded to allow the substance to be rehydrated or otherwise diluted.

Figure 1B:
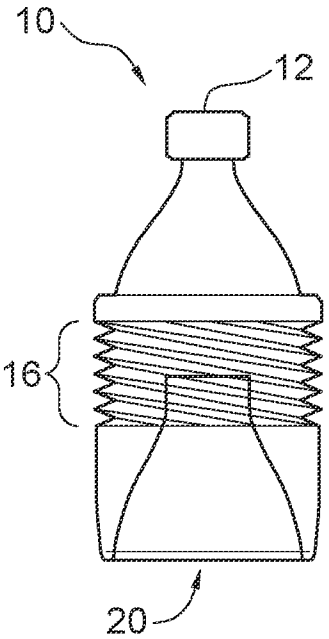
FIG. 1B is a side view illustrating the embodiment of FIG. 1 collapsed.
Figure 1A:
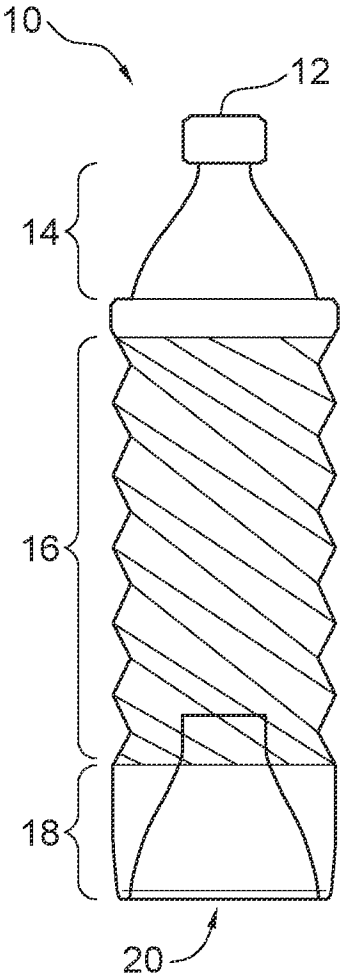
FIG. 1A is side view illustrating an embodiment of a collapsible bottle.

FIG. 1A is side view illustrating an embodiment of a collapsible bottle 10. In FIG. 1A, collapsible bottle 10 includes a cap 12 sealing an opening (not shown) within a neck 35 (FIG. 3A), an upper section 14, an expandible body 16 (shown expanded), a base 18, and a punt 20. Punt 20 is configured to accommodate cap 12 and upper section 14. As shown, expandable body 16 is expandable in an accordion or folded fashion with each fold being a continuous spiral from base 18 to next 14. In embodiment, expandable body 16 may be expandable in an accordion or folded fashion in which each fold makes a single circle (see body 36 of FIGS. 3A and 3B). In an embodiment, a spiral fold may be selected for improved mixing, with the continuity of the spiral, which provides a single, continuous groove from bottle bottom to top, promoting fluid motion more than a circular fold, which may function something like a series of dams or fluid speed bumps.

FIG. 1B is a side view illustrating the embodiment of FIG. 1 collapsed. In FIG. 1B, expandible body 16 is shown collapsed.

FIG. 1C is a side view illustrating the embodiment of FIG. 1 stacked. In FIG. 1C, multiple collapsed bottles 10*a* . . . 10*c* are shown stacked, with caps 12*b*, 12*c* received within punts 20*a*, 20*b*. In an embodiment, punts 20 and caps 12 may be configured such that a press-fit is formed between them when stacked as shown in FIG. 1C. Such a press-fit may be desired for maintaining the stack during loading, shipment, storage, and display.

Figure 2D:
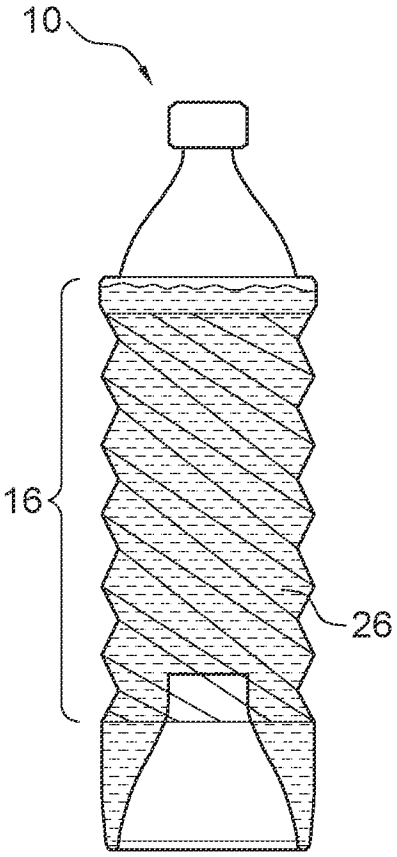
FIG. 2D is a side view illustrating the use case for the embodiment of FIG. 1 expanded, filled, and mixed.
Figure 2C:
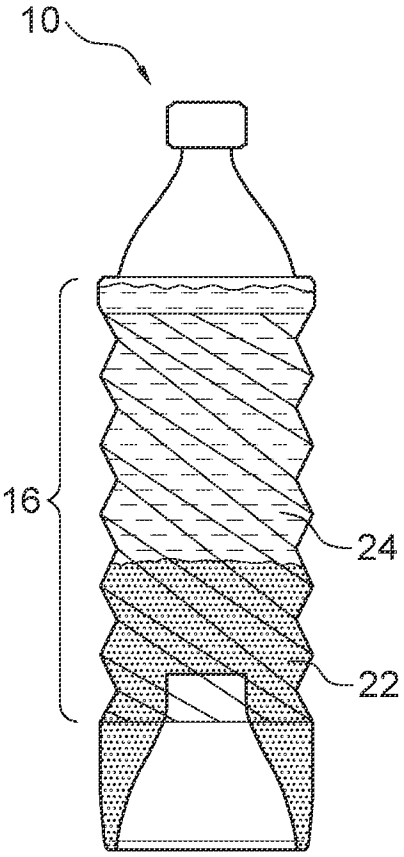
FIG. 2C is a side view illustrating the use case for the embodiment of FIG. 1 expanded and filled.
Figure 2B:
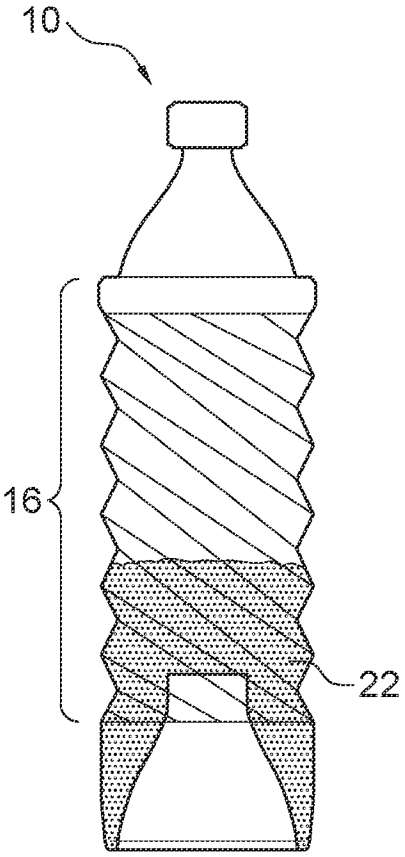
FIG. 2B is a side view illustrating the use case for the embodiment of FIG. 1 expanded.
Figure 2A:
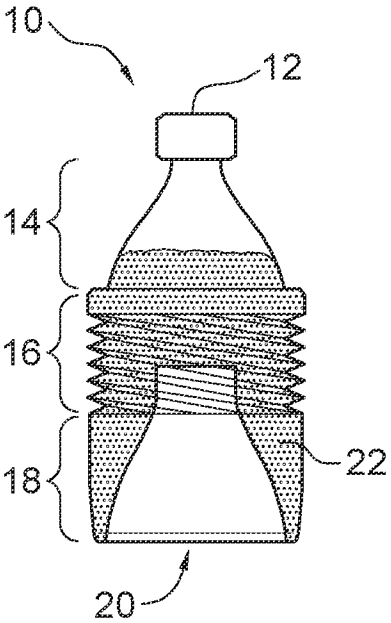
FIG. 2A is a side view illustrating a use case for the embodiment of FIG. 1 collapsed.

FIG. 2A is a side view illustrating a use case for collapsible bottle 10. In FIG. 2A bottle 10 is provided with a dehydrated or condensed food or substance 22. In FIG. 2B, body section 16 has been expanded, e.g., by removing cap 12, or unscrewing it enough to break the seal, and pulling upper section 14 away from bottom 18. In FIG. 2C, a liquid 24, e.g., water, has been added to body section 16. In FIG. 2D, condensed food or substance 22 and liquid 24 have been mixed to create a re-hydrated or diluted food or substance 26.

Figure 3B:
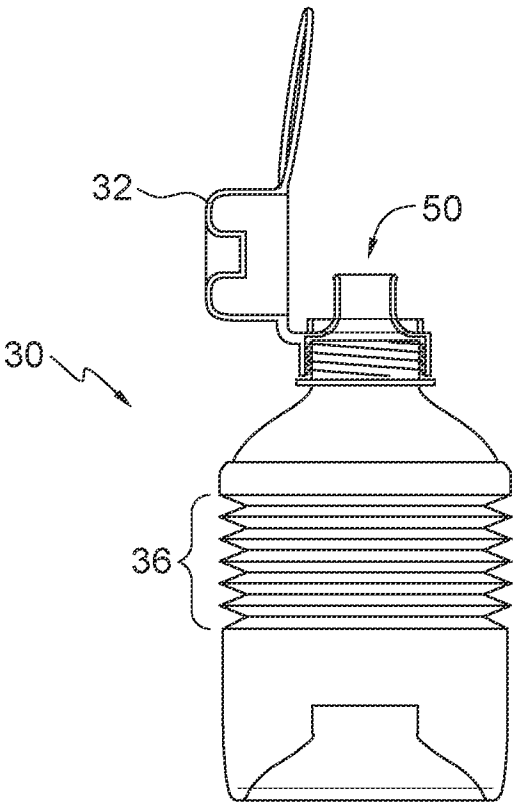
FIG. 3B is a side view illustrating the embodiment of FIG. 3A collapsed.
Figure 3A:
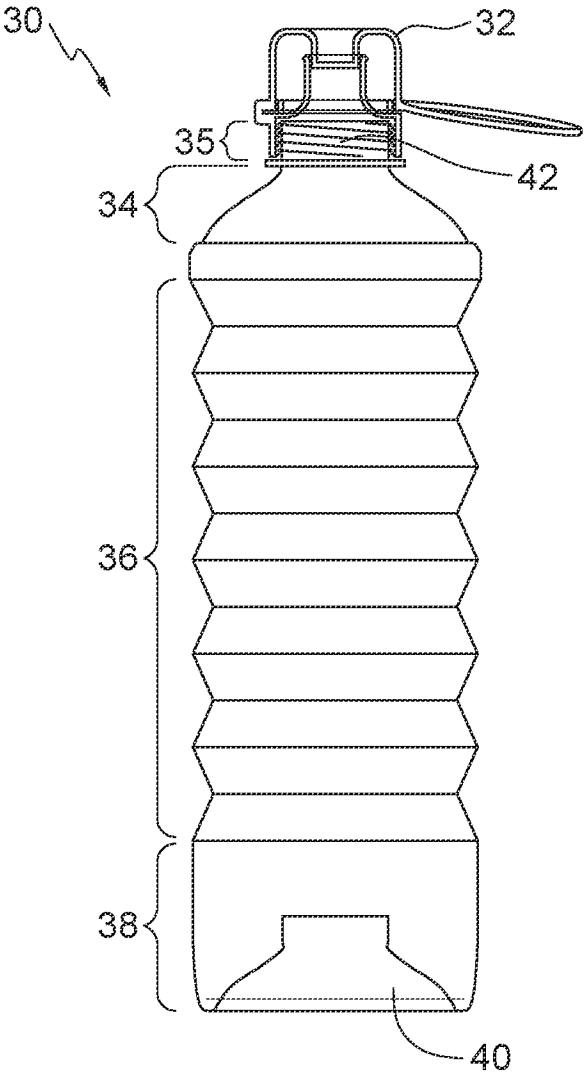
FIG. 3A is a side view illustrating an embodiment of a collapsible bottle.

FIG. 3A is a side view illustrating an embodiment of a collapsible bottle 30. In FIG. 3A, collapsible bottle 30 includes a cap 32 about a neck 35, an upper section 34, an expandible body 36 (shown expanded), a base 38, and a punt 40. In the embodiment, punt 40 is configured to accommodate upper section 34. Neck 35 includes threads 42. As shown, expandable body 36 is expandable in an accordion or folded fashion with each fold making single circle about body 36, but body 36 may be expandable in the spiral fashion shown in FIG. 1A as well. In embodiments, punt 40 may be configured to accommodate cap 32 and upper section 34.

FIG. 3B is a side view illustrating the embodiment of FIG. 3A collapsed and with cap 32 opened to allow access to an opening 50. In the configuration of FIG. 3B, and with cap 32 removed, or with just arm 49 removed and punt 40 configured to receive cap 32, bottle 30 may be stacked to save space, similar to the stacking shown in FIG. 1C.

Figure 3D:
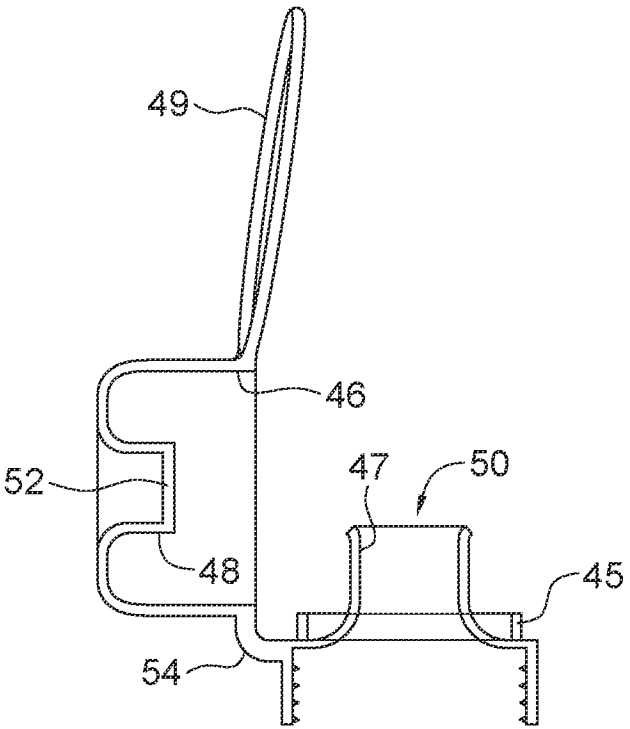
FIG. 3D is a side view illustrating the detail of FIG. 3C.
Figure 3C:
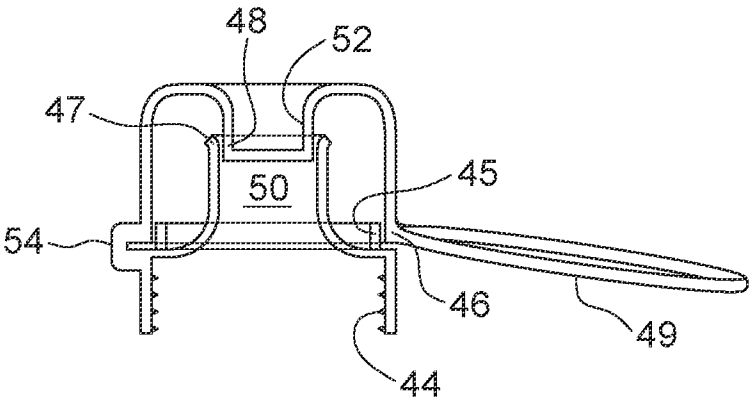
FIG. 3C is a side view illustrating a detail of an embodiment.

FIG. 3C is a side view illustrating detail of cap 32. Cap 32 includes threads 44, which cooperate with threads 42 to attach cap 32 to neck 35. Cap 32 includes a lip 45 above threads 44. A press-fit or partial press-fit of lip 45 within cap 32 at inner diameter 46 helps keep cap 32 closed. Cap 32 includes a flange (or edge) 47 that defines opening 50. An outer diameter 48 of a post 52 of cap 32 is received within flange 47 to also help keep cap 32 closed. In an embodiment, cap 32 may include an arm 49. Arm 49 may be leveraged to cause cap 32 to pivot about a hinge 54 and withdraw post 52 from opening 50. With cap 32 detached from threads 42, arm 49 may be used to stir the contents the bottle.

FIG. 3D is a side view illustrating the detail of FIG. 3C in an open configuration that allows access to opening 50.

Figure 4A:
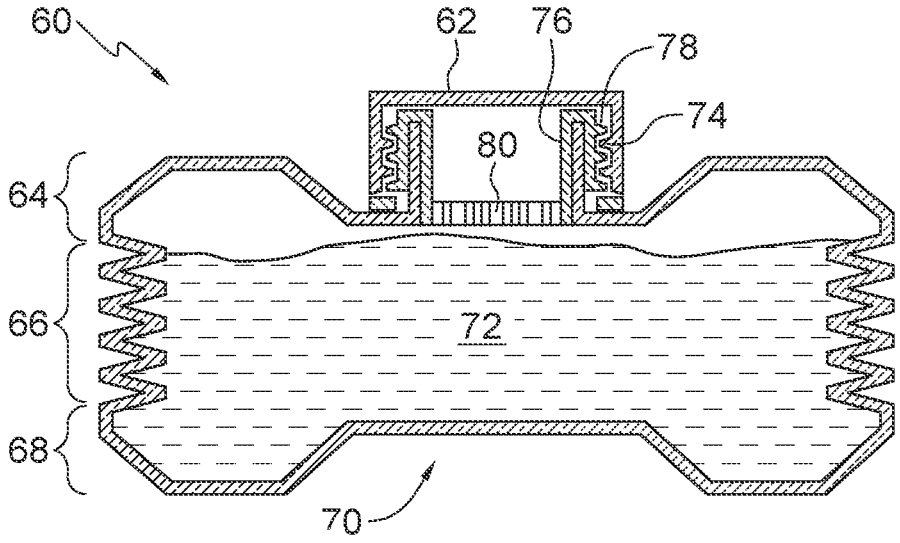
FIG. 4A is a side view illustrating an embodiment of a collapsible bottle.

FIG. 4A is a side view illustrating an embodiment of a collapsible bottle 60. In FIG. 4A, collapsible bottle 60 includes an upper section 64, a neck 65, an expandible body 66 (shown collapsed), a base 68, and a punt 70. Punt 70 is configured to accommodate a cap 62, an insert 76, and neck 65 when upper section 64 is in a retracted position (FIG. 4A). Neck 65 is received within insert 76, which includes threads 78. Threads 74 of cap 62 cooperate with threads 78 to seal bottle 60. In some embodiments, insert 76 may include a filter or mesh 80. In other embodiments, the area shown occupied by mesh 80 may be solid or open. In some embodiments, threads 78 may be formed directly into neck 65 with insert 76 not extending past the outside diameter of neck 65. In an embodiment, insert 76, threads 78, and mesh 80 may be one unit and welded into position on neck 65. In an embodiment, threads 78 may be provided in on neck 65 conventionally, and mesh 80 welded in place, without insert 76.

In FIG. 4A bottle 60 is provided with a dehydrated or condensed food or substance 72 to be rehydrated or diluted as discussed with regard to FIGS. 2A . . . 2D. As before, expandable body 66 may be expandable in an accordion or folded fashion with each fold making single circle about body 36, or in the spiral fashion shown in FIG. 1A as well.

Figure 4B:
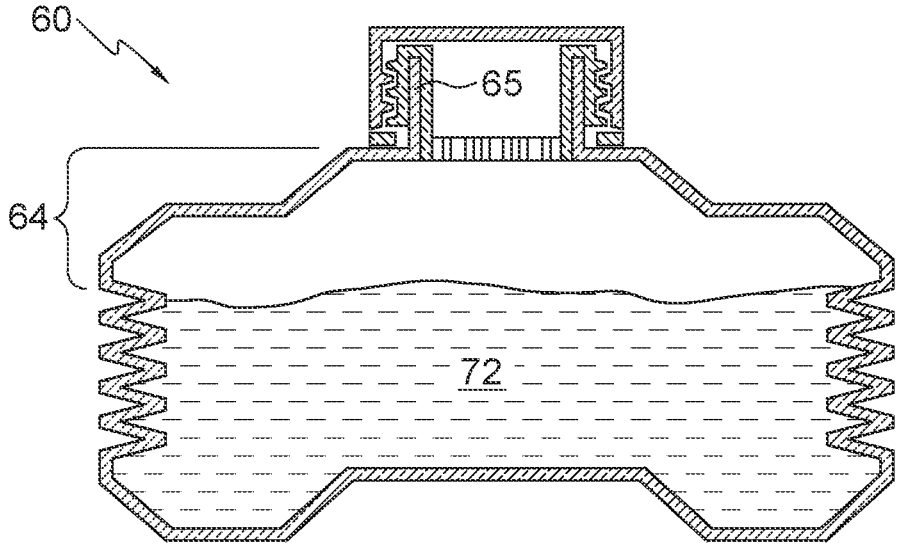
FIG. 4B is a side view illustrating the embodiment of FIG. 4A partially expanded.
Figure 4C:
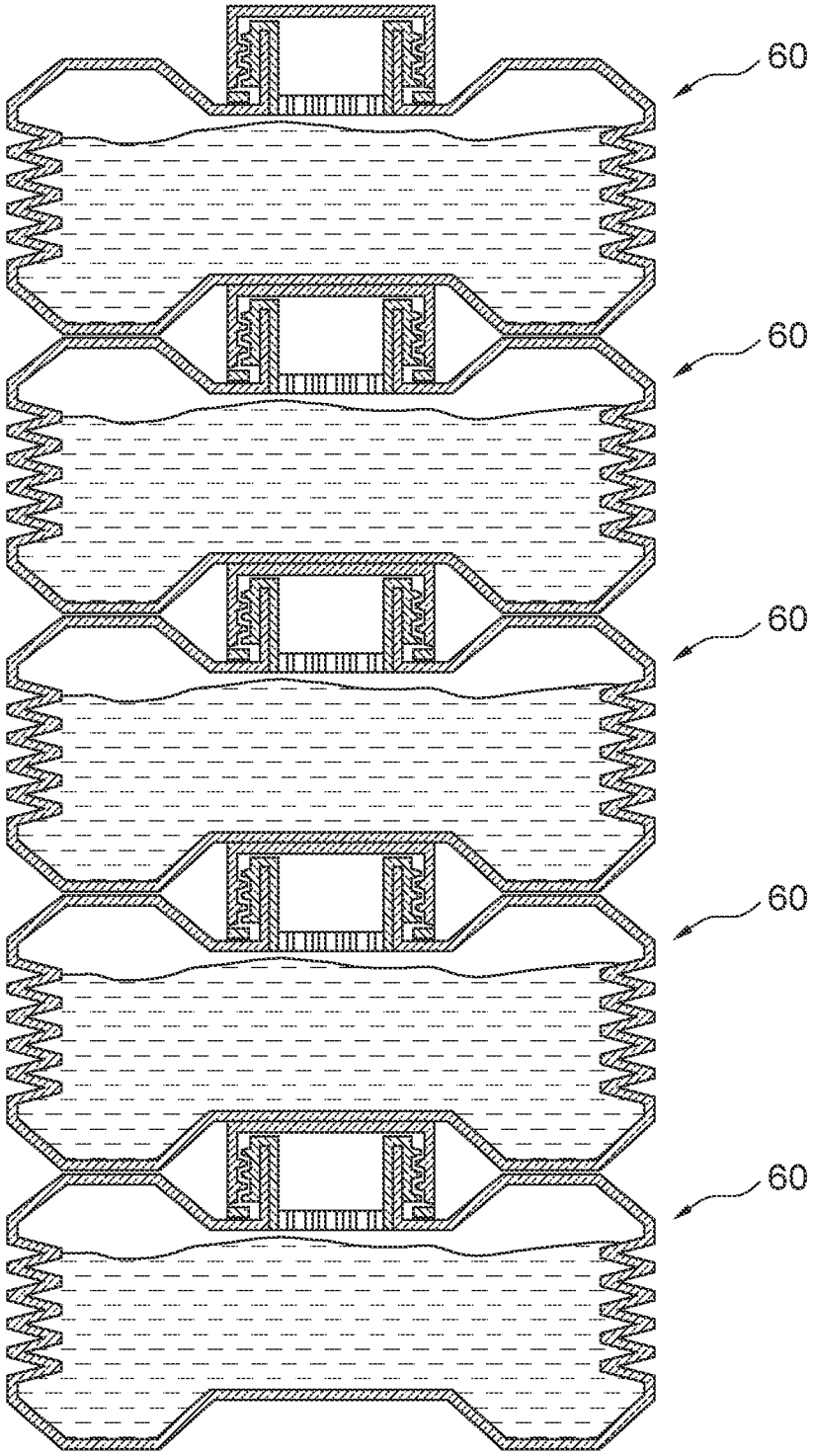
FIG. 4C is a side view illustrating the embodiment of FIG. 4A stacked

FIG. 4B is a side view illustrating the embodiment of FIG. 4A partially expanded such that upper section 64 is popped up, or extended. The ability of upper section 64 to pop, by itself and with body 66 remaining compressed, between a collapsed or retracted state (FIG. 4A) and an expanded or extended state (FIG. 4C) allows for bottle 60 to stack compactly, as shown in FIG. 4C. It is envisioned that bottle 60 may be used efficiently for relatively small servings of foodstuffs.

Figure 5A:
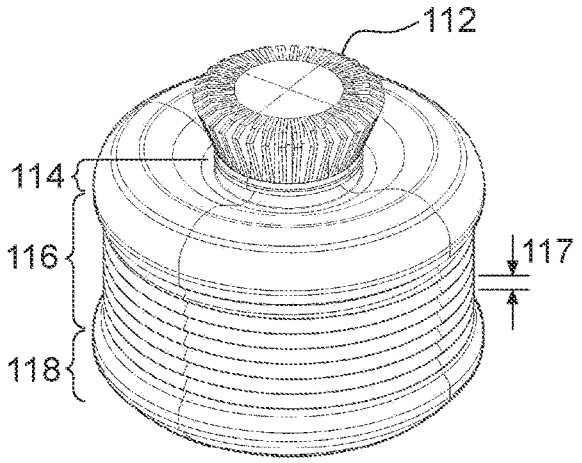
FIG. 5A is a perspective view is a side view illustrating an embodiment of a collapsible bottle in a collapsed state.
Figure 5B:
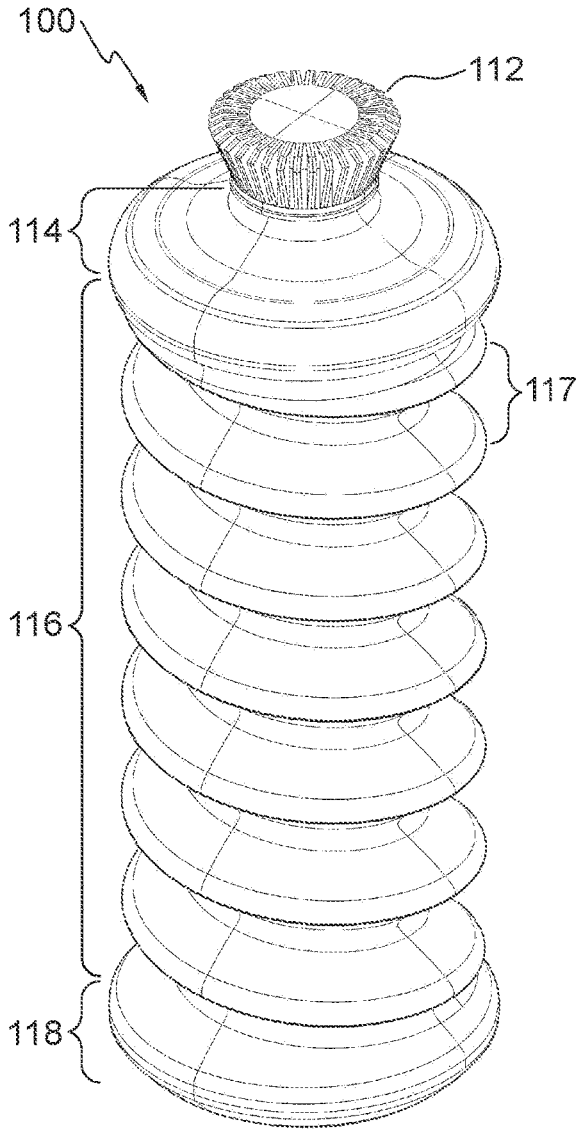
FIG. 5B is a side view illustrating the embodiment of a collapsible bottle of FIG. 5A in an expanded state.
Figure 6C:
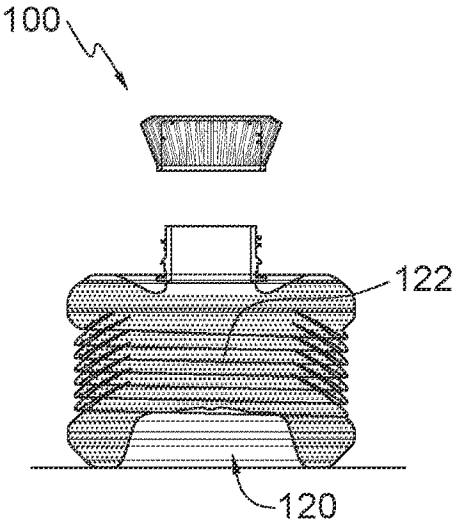
FIG. 6A-FIG. 6F are side views illustrating steps in an embodiment of a method of use of an embodiment of a collapsible bottle.
Figure 6B:
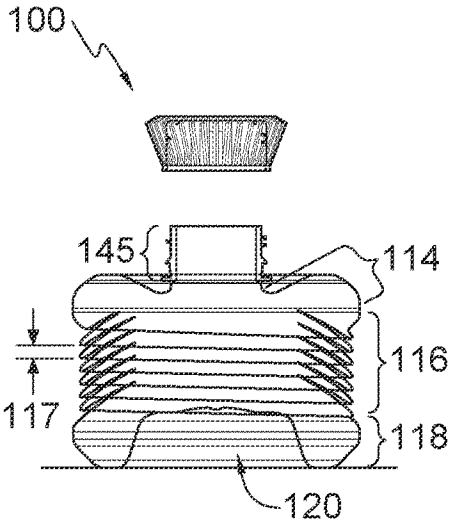
Figure 6A:
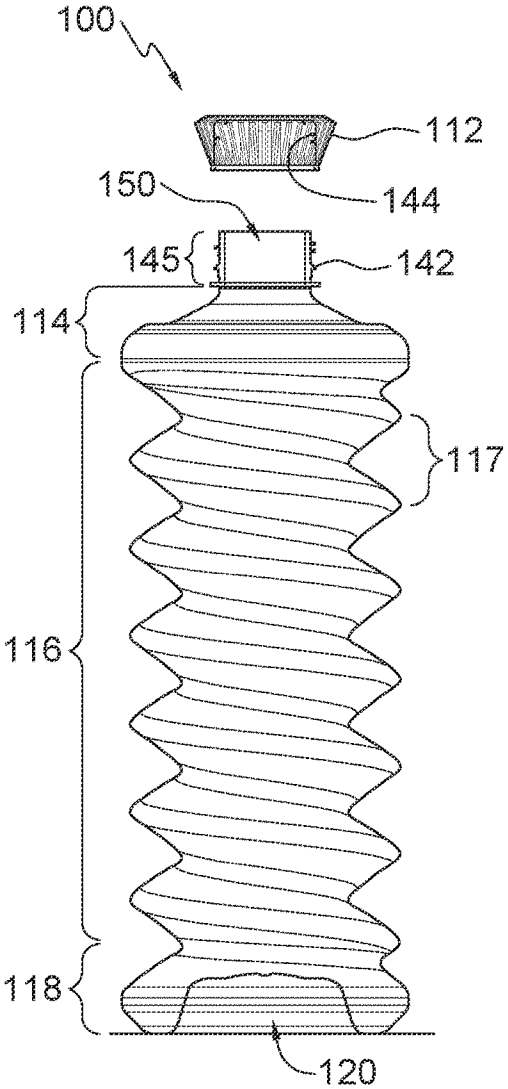
Figure 6F:
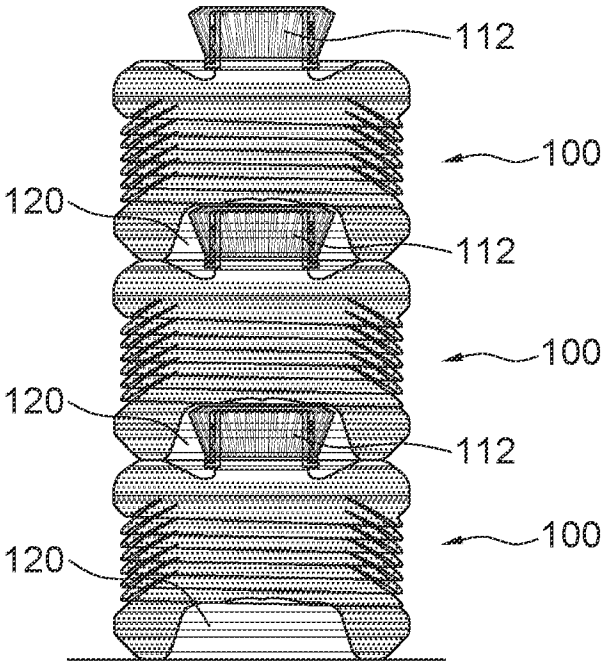

FIG. 5A is a perspective view is a side view illustrating an embodiment 100 of a collapsible bottle in a collapsed state. In FIG. 5A, collapsible bottle 100 includes a cap 112, an upper section 114 (shown retracted), an expandible body 116 (shown compressed), a base 118, and a punt 120 (FIG. 6A). Body 116 is compressed between upper section 114 and base 118. Punt 120 is configured to accommodate cap 112 and neck 145 (FIG. 6A) when upper section 114 is retracted. As shown, expandable body 116 is expandable in an accordion or folded fashion with each fold being a continuous spiral from base 118 to upper section 114. Spiral 117 indicates the longitudinal distance gained by one complete spiral in the compressed state. In an embodiment, expandable body 116 may be expandable in an accordion or folded fashion in which each fold makes a single circle (see body 136 of FIG. 8).

FIG. 5B is a side view illustrating the embodiment of a collapsible bottle of FIG. 5A in an expanded state. In the expanded state, each spiral 117 has been expanded and upper section 114 extended as well from being concave in FIG. 5A to convex in FIG. 5B.

FIG. 6A-FIG. 6F are side views illustrating steps in an embodiment of a method of use of an embodiment of a collapsible bottle. FIG. 6A further illustrates that cap 112 includes threads 144, which cooperate with threads 142 to attach cap 112 to neck 65 and seal opening 150.

Figure 6E:
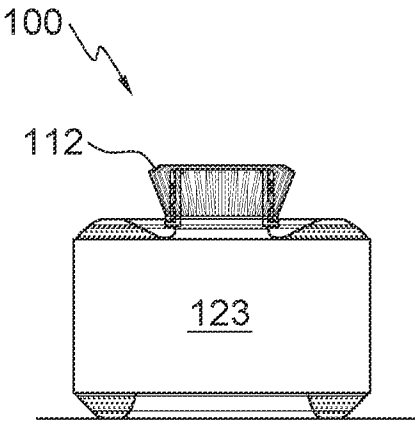
Figure 6D:
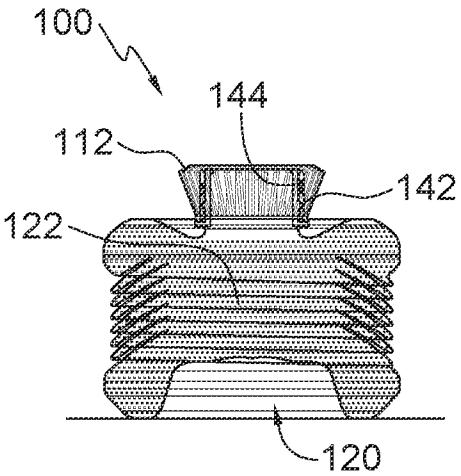

In FIG. 6A, in a first step of a method, bottle 100 and cap 112 are manufactured. In FIG. 6B, upper section 114 and body 116 are compressed, separately or at the same time. In FIG. 6C, compressed bottle 100 is filled with a substance 122, e.g., a dehydrated or condensed material, such as a foodstuff. In FIG. 6D, bottle 100 is capped. In FIG. 6E, bottle 100 may receive a label 123. And in FIG. 6F, after multiple bottles have undergone the steps of FIG. 6A-FIG. 6E, the bottles may be stacked, with cap 112 being received within punt 120, e.g., for packaging, shipment, and/or display. In an embodiment, it is envisioned that the steps illustrated by FIG. 6A-FIG. 6F would be performed by a manufacturer or other commercial entity.

In an embodiment, the volume of compressed bottle 100 (FIG. 6B) and the volume of expanded bottle 100 (FIG. 6A) may be both be predetermined volumes such that, for a particular substance 112, when compressed bottle 100 is filled with the substance, and the bottle 100 is subsequently expanded, filling expanded bottle 100 with a designated fluid brings the particular substance 112 to a predetermined concentration or consistency.

Figure 7D:
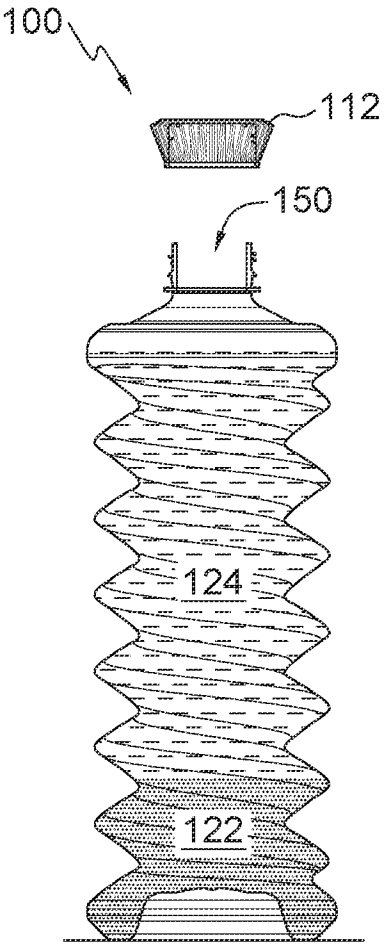
FIG. 7A-FIG. 7H are side views illustrating steps in an embodiment of a method of use of an embodiment of a collapsible bottle.
Figure 7C:
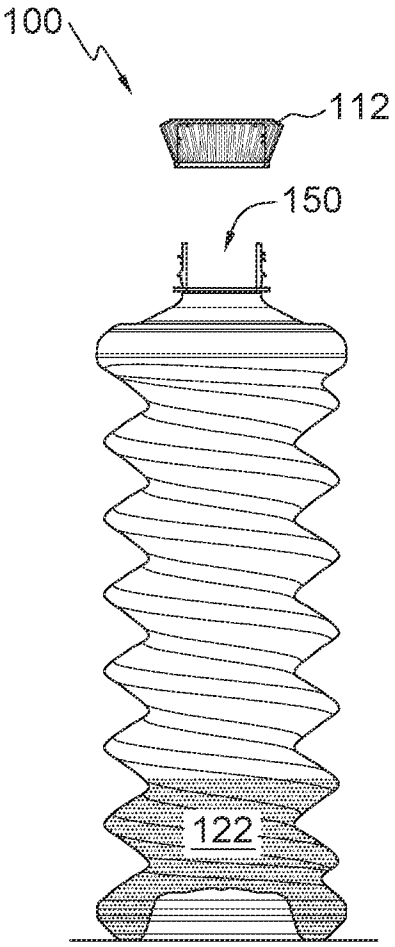
Figure 7B:
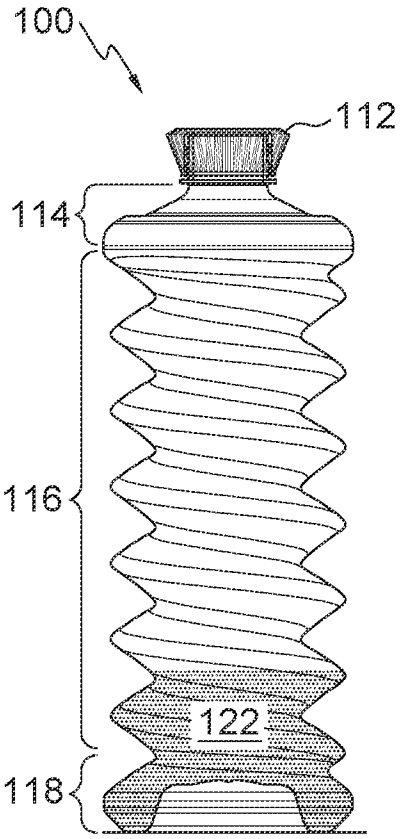
Figure 7A:
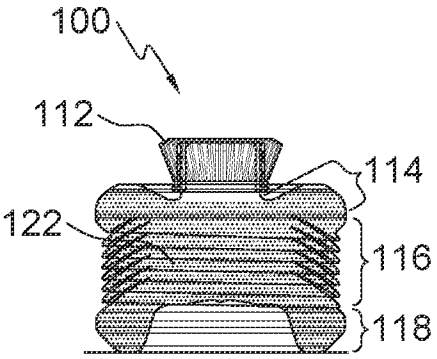
Figure 7H:
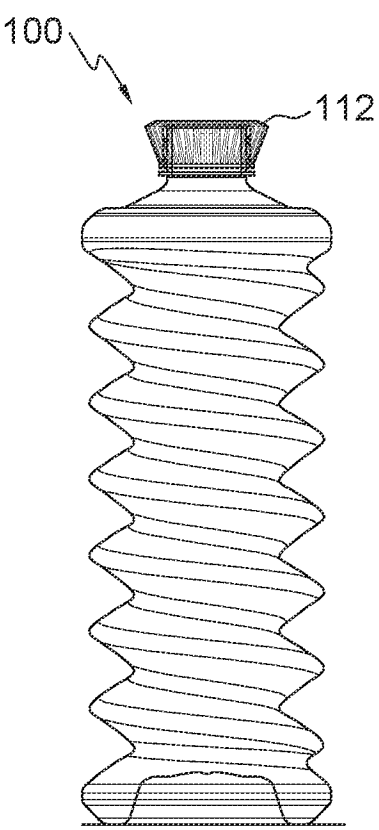
Figure 7G:
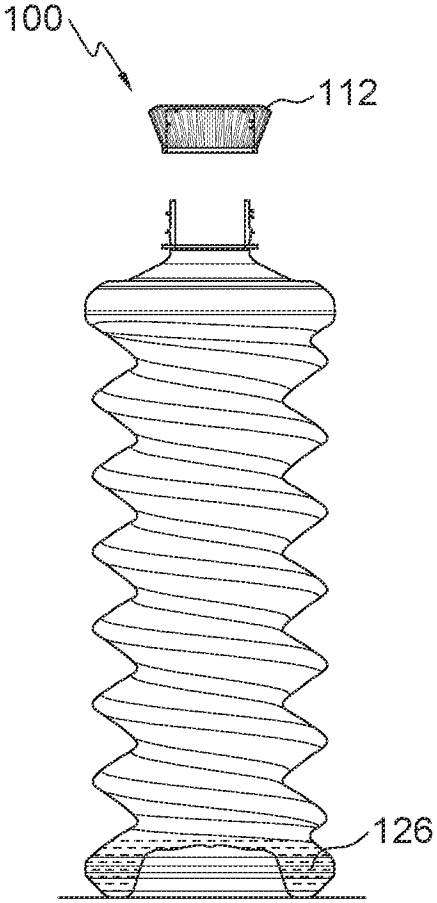
Figure 7F:
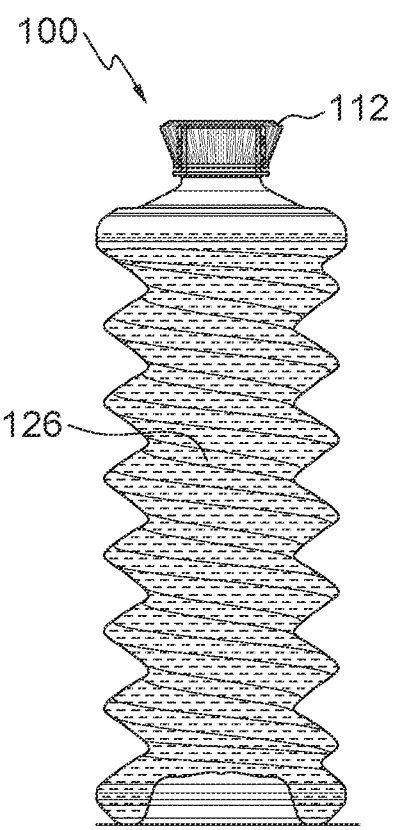
Figure 7E:
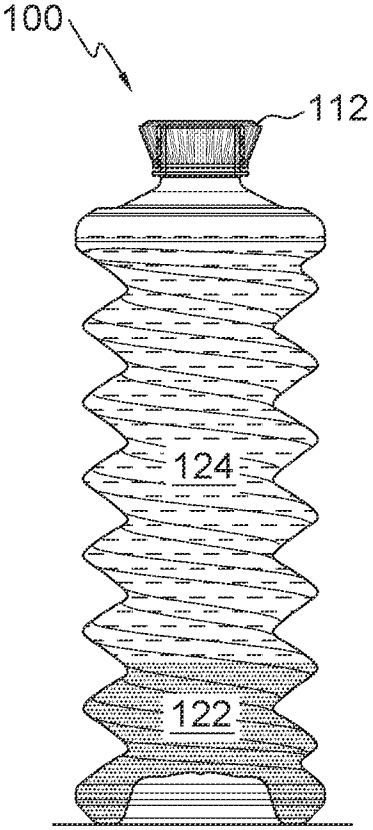

FIG. 7A-FIG. 7H are side views illustrating steps in an embodiment of a method of use of an embodiment of a collapsible bottle. In FIG. 7A, a bottle 100 is obtained that has completed the method of FIG. 6A-FIG. 6F. In FIG. 7B, body section 116 has been expanded, e.g., by removing cap 112, or unscrewing it enough to break the seal, and pulling upper section 114 away from bottom 118. In FIG. 7C, bottle 100 is uncapped and both upper section 114 and body 116 are fully expanded. In FIG. 7D, a liquid 124 is added, e.g., to the fill line 146. In FIG. 7E, bottle 100 is re-capped and shaken to mix. In FIG. 7F, the mixing is shown to result in a reconstituted substance 126. In FIG. 7G, reconstituted substance 126 is used, e.g., consumed or applied. And in FIG. 7H, empty bottle may be recycled or re-used. In an embodiment, it is envisioned that the steps illustrated by FIG. 7A-FIG. 7H would be performed by a manufacturer or other commercial entity.

Figure 8A:
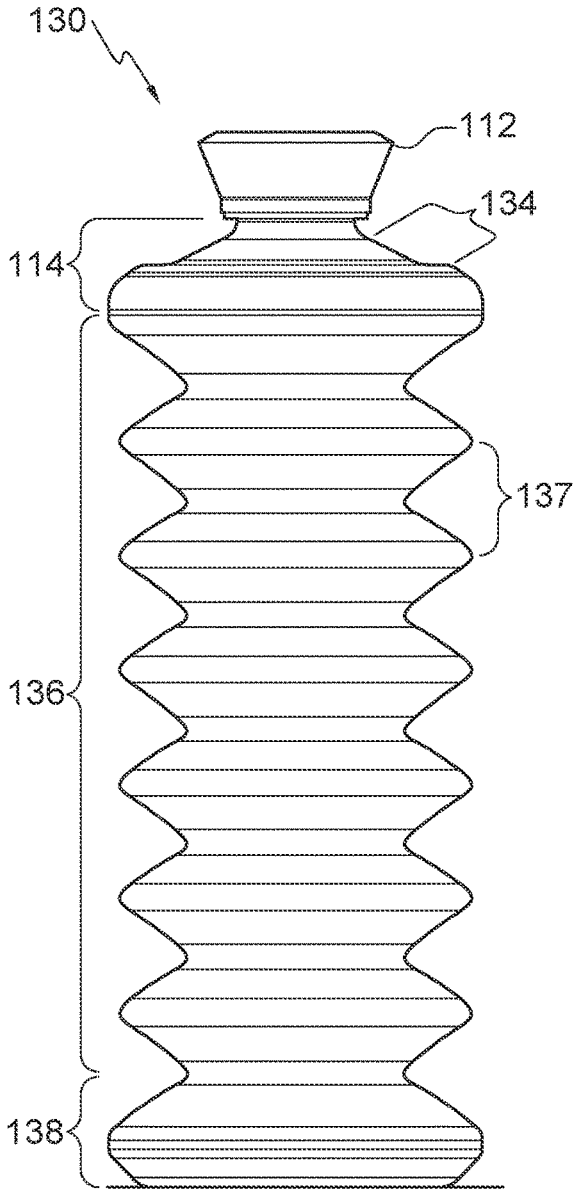
FIG. 8A is a side view illustrating an embodiment of a collapsible bottle.

FIG. 8A is a side view illustrating an embodiment of a collapsible bottle 130 including an upper section 114, a body 136, and a bottom section 138. Body 136 includes a number of folds 137, each fold 137 making a single circle about body 136. Upper section 114 is the same for both bottle 100 and bottle 130.

Figure 8B:
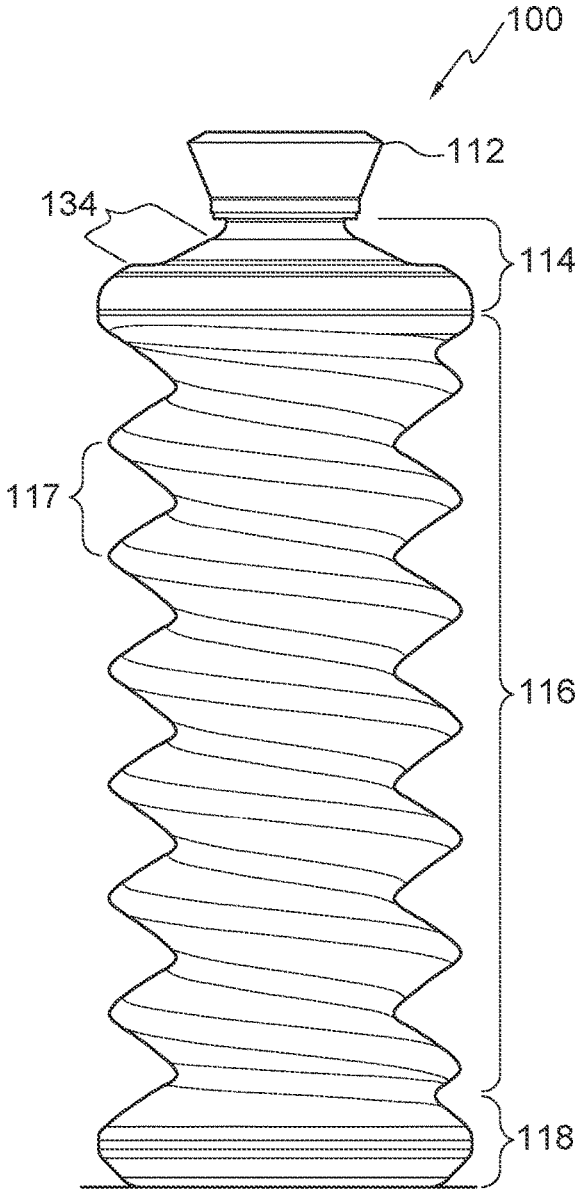
FIG. 8B is a side view illustrating an embodiment of a collapsible bottle.

FIG. 8B is a side view illustrating an embodiment of collapsible bottle 100, which, when compared to bottle 130 of FIG. 8A, illustrates the similarity of upper sections 114 and the differences between bodies 116, 136, and between bottom section 118, 138.

Figure 9B:
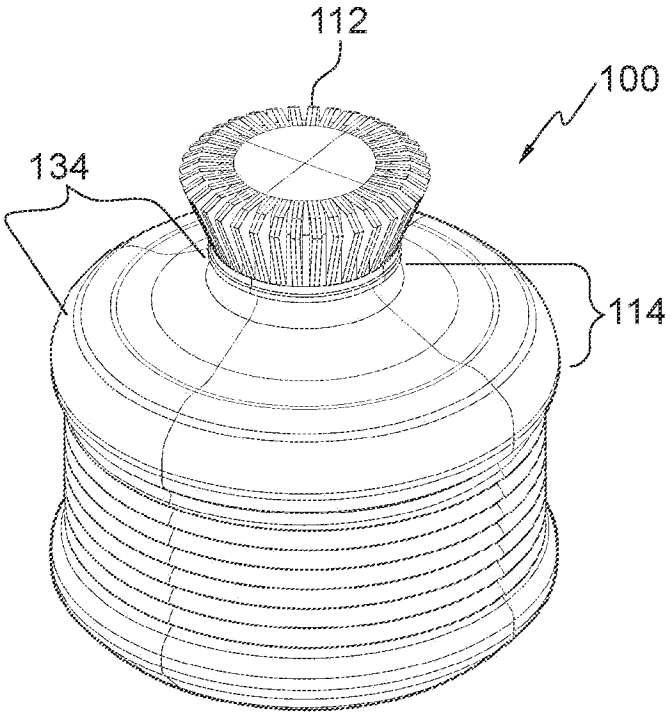
FIG. 9B is a side view illustrating the embodiment of a collapsible bottle of FIG. 9A in a partially expanded state.
Figure 9A:
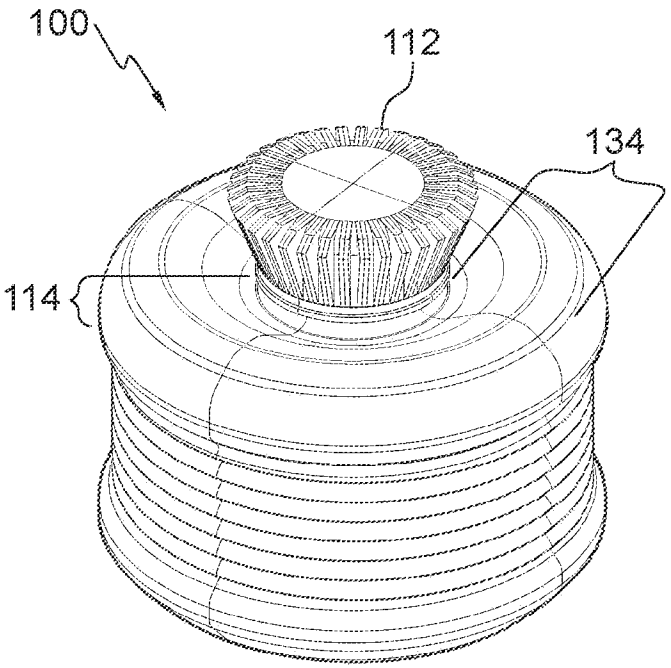
FIG. 9A is a perspective view is a side view illustrating an embodiment of a collapsible bottle in a collapsed state.

FIG. 9A is a perspective view is a side view illustrating bottle 100 in a collapsed state. FIG. 9B is a side view illustrating bottle 100 in a partially expanded state. FIG. 9A and FIG. 9B illustrate that flexible section 134 of upper section 114 may be pulled and extended with respect to the lower outer perimeter of upper section 114 to go from the concave orientation of FIG. 9A to the convex orientation of FIG. 9B.

Figure 10:
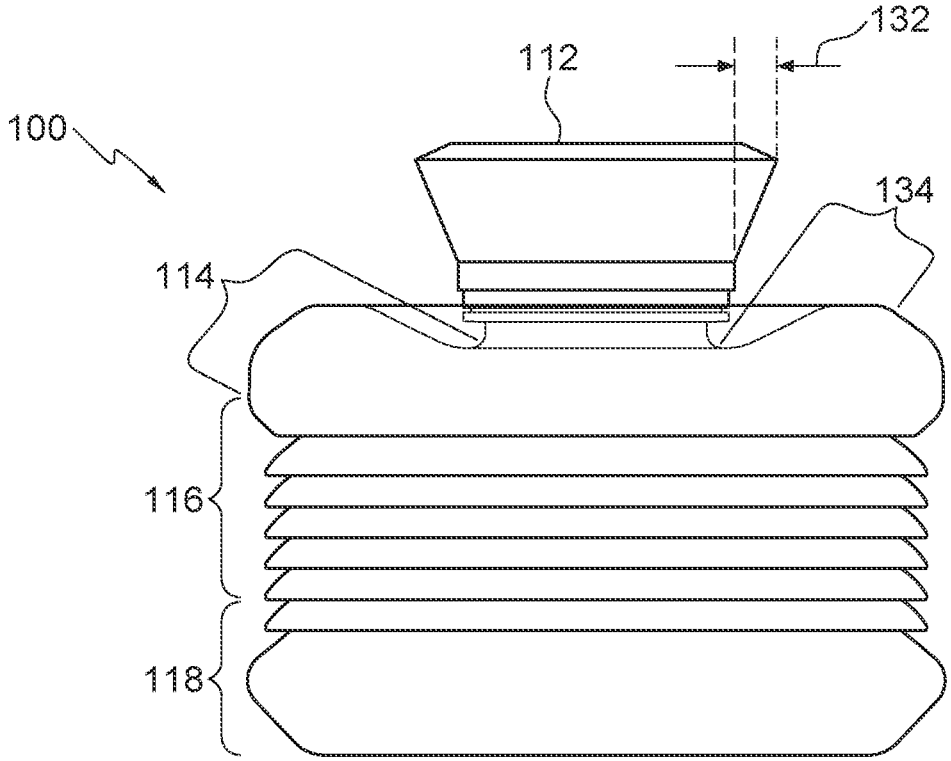
FIG. 10 is a side view illustrating the embodiment of a collapsible bottle of FIG. 9A.

FIG. 10 is a side view illustrating the embodiment of collapsible bottle 100 of FIG. 9A. In FIG. 10, cap 112 is shown to include an undercut 132, which facilitates grasping cap 112 and pulling to expand bottle 100.

The previous description is provided to enable any person skilled in the art to practice the various aspects described herein. In the embodiments, the separation of various system components in the embodiments described above should not be understood as requiring such separation in all embodiments. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

All structural and functional equivalents to the elements of the various aspects described throughout this disclosure that are known or later come to be known to those of ordinary skill in the art are expressly incorporated herein by reference and are intended to be encompassed by the claims.

What is claimed is:

1. A bottle comprising:
- a pliant material;
- a top section including a first opening;
- a bottom section; and
- a body including at least one fold completely traversing a perimeter of the bottle and including a first side and a second side and an angle between the first and second sides, wherein:
  - the bottle has a compressed state in which the angle is relatively smaller and an expanded state in which the angle is relatively larger;
  - when the bottle is in the compressed state the at least one fold is exposed; and
  - when the bottle is in the compressed state, a first perimeter of the top section and a second perimeter of the bottom section are greater than a maximum perimeter of the exposed at least one fold such that the first perimeter and second perimeter may be grasped to pull the bottle from the compressed state to the expanded state.

2. The bottle of claim 1, wherein either: the at least one fold includes a plurality of folds and each fold traverses the perimeter of the bottle from an initial point such that as the fold is followed about the perimeter of the bottle the fold returns to the initial point; or the at least one fold includes a single spiral that traverses the perimeter of the bottle a plurality of times and, as the spiral is followed about the perimeter of the bottle, the longitudinal position of the spiral changes.

3. The bottle of claim 1, wherein the bottom section is configured to receive the top section when the top section is fitted with a cap such that a first bottle may be stacked atop a second bottle identical to the first.

4. The bottle of claim 3, wherein the bottom section and cap are configured such that there is a first press fit between the bottom section and the cap when the top section is received by the bottom section.

5. The bottle of claim 3 in the compressed state, further including a substance, wherein the substance is brought to a predetermined concentration when the bottle is expanded to the expanded state and filled with a liquid.

6. The bottle of claim 3, wherein:

the top section includes the first opening;

and a perimeter of the cap increases as the cap extends away from the body such that the increasing perimeter facilitates grasping the cap to pull the bottle from the compressed state to the expanded state.

7. The bottle of claim 1, further comprising a cap including:

a second opening with an inner edge;

a first flange around the second opening;

a lid including: an inner edge and a post having an outer edge; and a hinge connecting the cap and the lid, wherein:

the second opening is sealed by a second press fit between the inner edge and the post when the lid pivots about the hinge and the post enters the second opening; and a third press fit between the first flange and the inner edge is formed when the lid pivots about the hinge and the post enters the second opening, the third press fit assisting in maintaining the post within the second opening.

8. The bottle of claim 1, wherein the top section includes a flexible cone section between the first opening and a periphery of the top section, the flexible cone section flexing between a first retracted position relatively toward the body and an extended position relatively away from the body, the retracted position and the extended position being possible regardless of whether the bottle is in the compressed state or expanded state.

9. The bottle of claim 1, further comprising a filter configured to be received within the first opening.

10. The bottle of claim 9, wherein the filter is provided within an insert configured to receive a neck of the bottle, the insert including threads configured to cooperate with threads of a cap.

11. The bottle of claim 1, wherein the at least one fold is bi-stable such that force is required to change the bottle from the compressed state to the expanded state, or from the expanded state to the compressed state, and not required to maintain the bottle in either the compressed state or the expanded state.

12. The bottle of claim 11, wherein force required to change the bottle from the compressed state to the expanded state, or from the expanded state to the compressed state, is required to deform the pliant material as an apex of the at least one fold moves away from a center axis of the bottle.

13. A method of using a collapsible bottle comprising:

obtaining the collapsible bottle in a compressed state and provided with a substance, the collapsible bottle including:

a pliant material, a top section including a first opening, a bottom section, a cap configured to seal the first opening, and a body including at least one fold completely traversing a perimeter of the bottle and including a first side and a second side and an angle between the first and second sides, wherein:

the bottle has the compressed state in which the angle is relatively smaller and an expanded state in which the angle is relatively larger;

when the bottle is in the compressed state the at least one fold is exposed; and when the bottle is in the compressed state, a first perimeter of the top section and a second perimeter of the bottom section are greater than a maximum perimeter of the exposed at least one fold such that the first perimeter and second perimeter may be grasped to pull the bottle from the compressed state to the expanded state:

expanding the collapsible bottle to the expanded state;

adding a liquid to the expanded collapsible bottle; and mixing the liquid with the substance to dilute the substance a pre-determined amount or to obtain a pre-determined consistency.

14. The method of claim 13, wherein the mixing the liquid with the compressed substance to dilute the compressed substance a pre-determined amount or to obtain a pre-determined consistency further comprises:

moving the collapsible bottle about an axis parallel to a center axis of the bottle, the movement causing at least some of the liquid to move about the center axis and within a groove defined by the at least one fold.

15. The method of claim 14, wherein the at least one fold includes a spiral that traverses the perimeter of the bottle a plurality of times such that the groove is continuous, the moving the collapsible bottle about an axis parallel to a center axis of the bottle further causing at least some of the liquid to have a component of movement along the center axis.

16. A method of using a first collapsible bottle comprising:

obtaining the first collapsible bottle in an expanded state; the first collapsible bottle including:

a pliant material, a top section including a first opening, a bottom section, a cap configured to seal the first opening, and a body including at least one fold completely traversing a perimeter of the bottle and including a first side and a second side and an angle between the first and second sides, wherein:

the bottle has the compressed state in which the angle is relatively smaller and an expanded state in which the angle is relatively larger;

when the bottle is in the compressed state the at least one fold is exposed; and when the bottle is in the compressed state, a first perimeter of the top section and a second perimeter of the bottom section are greater than a maximum perimeter of the exposed at least one fold such that the first perimeter and second perimeter may be grasped to pull the bottle from the compressed state to the expanded state:

compressing the first collapsible bottle to the compressed state;

adding a substance to the first compressed collapsible bottle; and, after the addition, capping the first compressed collapsible bottle.

17. The method of claim 16, further comprising:

stacking a second capped compressed collapsible bottle atop the first capped compressed collapsible bottle.

18. The method of claim 17, wherein a press fit is created between the cap of the first capped compressed collapsible bottle and a bottom of the second capped compressed collapsible bottle.

19. The method of claim 16, further comprising:

flexing a flexible cone surrounding the first opening from an extended position to a retracted position; and stacking a second capped compressed collapsible bottle atop the first capped compressed collapsible bottle, wherein a height of the stacked bottles is less with the flexible cone in the retracted position than possible when the flexible cone remains in the extended position.

* * * * *